United States Patent [19]

Gressitt

[11] 4,040,701

[45] Aug. 9, 1977

[54] QUICK CONNECTOR FOR SERVICE WIRES

[75] Inventor: Tillman Johnson Gressitt, Long Valley, N.J.

[73] Assignee: Bell Telephone Laboratories, Incorporated, Murray Hill, N.J.

[21] Appl. No.: 710,020

[22] Filed: July 30, 1976

[51] Int. Cl.[2] ..... H01R 9/08

[52] U.S. Cl. ..... 339/99 R; 339/94 M

[58] Field of Search ..... 339/94 R, 94 A, 94 C, 339/94 M, 97 R, 97 P, 98, 99, 217 R

[56] References Cited

U.S. PATENT DOCUMENTS

| | | | |
|---|---|---|---|
| 2,627,537 | 2/1953 | Weisberg | 339/99 R |
| 2,647,245 | 7/1953 | Gilbert | 339/99 R |
| 2,704,355 | 3/1955 | Holton | 339/94 A |
| 3,087,137 | 4/1963 | Linn | 339/217 R |
| 3,411,130 | 11/1968 | Bushey | 339/94 M |
| 3,636,500 | 1/1972 | Sedlacek | 339/97 R |
| 3,836,943 | 9/1974 | Horak | 339/97 P |

*Primary Examiner*—Roy Lake
*Assistant Examiner*—Mark S. Bicks
*Attorney, Agent, or Firm*—John W. Fisher

[57] ABSTRACT

A connector block for terminating unprepared communication service wires is disclosed. Pairs of spaced-apart, laterally offset, quick-connect terminals make electrical connections with opposite sides of insulation covered electrical conductors comprising the service wire when the wire is inserted into the connector block and the terminals and conductors are urged into engagement with one another.

19 Claims, 7 Drawing Figures

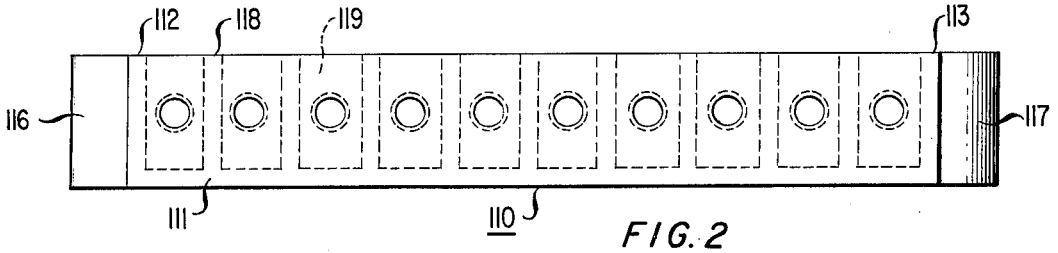
FIG. 2
FIG. 3
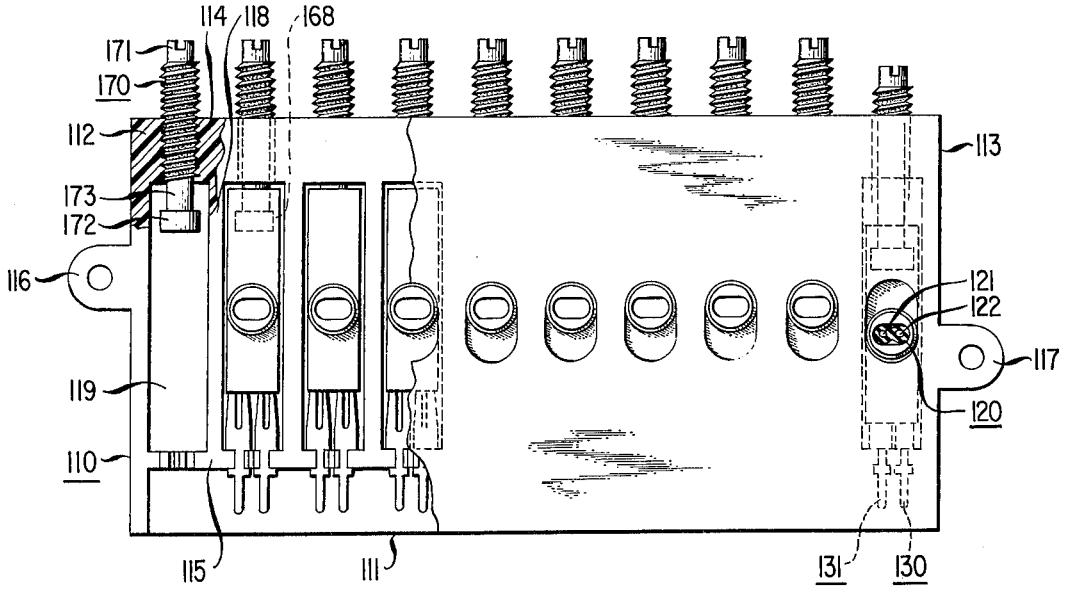
FIG. 4
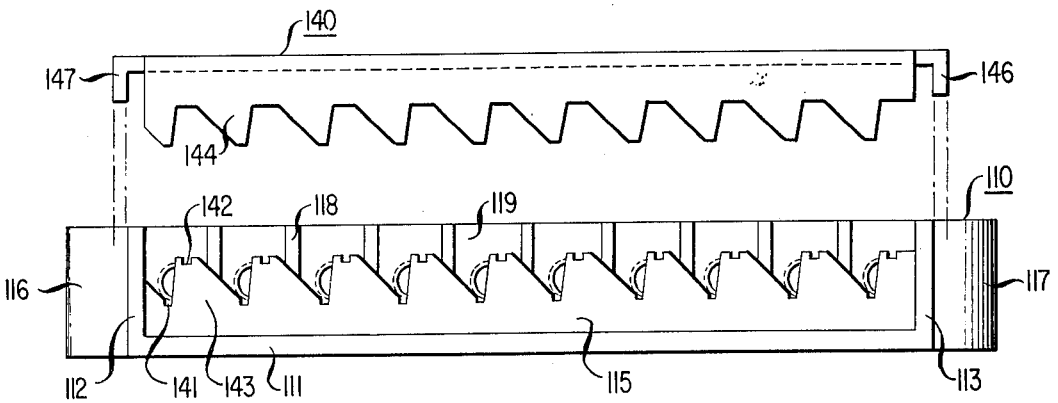

QUICK CONNECTOR FOR SERVICE WIRES

BACKGROUND OF THE INVENTION

1. Field of the Invention

This invention relates to an electrical connector and, in particular, to an electrical connector which utilizes piercing means to effect a connection with communication service wires.

2. Description of the Prior Art

In a communication system, connection of a subscriber's premises with a feeder cable is effected, in general, either with an aerial service drop wire or with a buried service wire. Termination of either of these service wires at the subscriber's premises typically requires the performances of several steps by an installer. These steps include separating the two conductors in the service wire, removing a portion of the insulation at the conductor ends, looping the bared conductor end around a screw terminal and tightening the screw. This procedure is not only time consuming, and therefore, expensive, but quite often leaves a portion of the bared conductors exposed to environmental effects. Such exposure can result in a degradation of the quality of the electrical connection which, in turn, can lead to an impairment in the quality of service provided. Since many thousands of service wire connections are made each year, it is most desirable that a reliable termination be made while at the same time reducing the time and expense involved in effecting such a termination.

Some connectors, such as those disclosed in U.S. Pat. No. 3,768,067, issued to P. Rault on Oct. 23, 1973, and U.S. Pat. No. 3,902,780, issued to F. P. Dola on Sept. 2, 1975, include provisions for terminating wires without special preparation of the conductor ends. For example, the Rault connector may be used to terminate an insulated flat cable by the utilization of a conductive tooth which bites into the insulation and makes electrical contact with the conductor. The Dola connector, on the other hand, utilizes a cylindrical body into which a pair of insulated conductors are inserted at right angles. Tightening a screw positioned atop the two conductors extrudes the insulation from the conductors at the point of contact thereby completing a connection.

Neither of the aforementioned connectors is suitable for reliably terminating aerial drop or buried service wires, especially service wires covered with an abrasive resistant insulation whose integrity must be maintained over a temperature range of −40° F. to +140° F. In particular, an abrasive resistant insulation, such as polyvinylchloride, at a temperature of 0° F. or lower, is extremely hard. Attempts to effect connections to service wires of this variety with the Rault or Dola connectors would be extremely difficult if not impossible and would be less than reliable. Moreover, it is doubtful whether either of these connectors could be used to effect repeated terminations of the type of service wire described previously.

Accordingly, it is one object of the present invention to eliminate the need for advance preparation of the conductor ends to effect a service wire termination.

Another object is to provide a service wire connector which is reliably and repeatably operable over a temperature range of from −40° F. to +140° F.

A futher object of the present invention is to encase a completed termination to reduce exposure to environmental contaminants.

Yet another object is to standardize the method of effecting a termination by an installer thereby further improving the reliability of the termination through uniformity.

Still a further object of the present invention is to decrease the amount of time required and, therefore, the cost of effecting a service wire termination.

An even further object is to configure a connector which can be advantageously utilized for either aerial drop or buried service wires.

SUMMARY OF THE INVENTION

The foregoing and other objects of the invention are realized in an illustrative embodiment of a terminal block which includes at least one pair of insulation penetrating quick-connect terminals. Each of these terminals has provision for making an electrical connection with opposite sides of an insulation-covered electrical conductor. The terminal block further includes means for accepting a coupled pair of insulation-covered electrical conductors, the accepting means having first and second grooves therein displaced from one another so as to be in alignment with the pair of insulation penetrating quick-connect terminals. Means are provided for urging the accepting means and the pair of insulation penetrating quick-connect terminals into engagement with one another to complete a connection.

Accordingly, it is one feature of the present invention that a communication service wire can be advantageously terminated quickly, uniformly, reliably and repeatedly.

Another feature is that advance preparation of the conductor ends is eliminated.

A further feature of the present invention is that reliable terminations can be advantageously effected over a temperature range of −40° F. to +140° F.

Still another feature is that the terminal block is configured to accept both aerial drop and buried service wires.

Yet a further feature of the present invention is that a completed connection is sealed against environmental contaminants thereby improving its corrosion resistivity.

BRIEF DESCRIPTION OF THE DRAWING

The aforementioned objects and features of the invention, as well as other objects and features, will be better understood upon a consideration of the following detailed description and the appended claims taken in conjunction with the accompanying drawings in which:

FIG. 2 is a first side view of the terminal block illustrating the alignment of apparatus for urging the quick-connect terminals and the service wire into engagement with one another.

FIG. 3 is a top view of the terminal block illustrating the relative position of the quick-connect terminals with respect to the service wire accepting means;

FIG. 4 is a second side view of the terminal block illustrating the technique used for aligning and anchoring the quick-connect terminals in the block;

DETAILED DESCRIPTION

Figure 1:
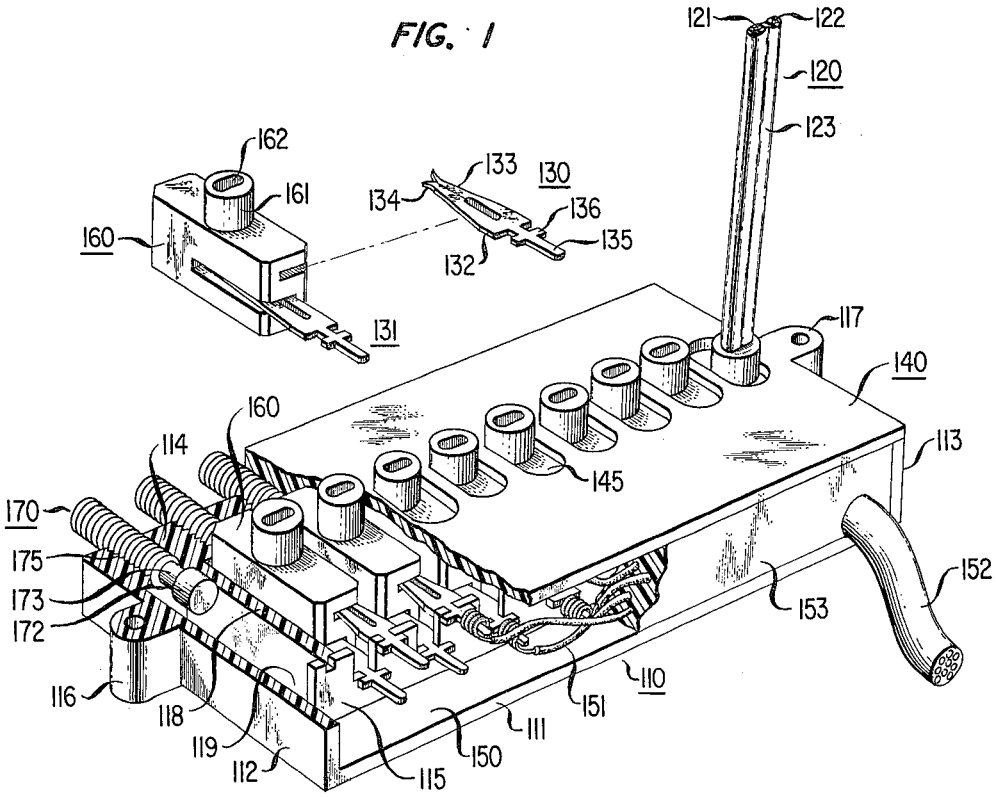
FIG. 1 is a partially exploded perspective view of the terminal block.

The wire terminal block, shown in the partially exploded perspective view of FIG. 1, includes a body member 110 comprised of a base 111, ends 112 and 113, and sides 114 and 115. Integral with ends 112 and 113 are tabs 116 and 117, respectively, for mounting the terminal block to a support structure such as an exterior wall of a subscriber's premises. Internal to body member 110 are a plurality of walls 118, as shown in FIG. 2, which partition the space into a plurality of separate rectangular cavities 119. Cavities 119 extend laterally across a width dimension of body member 110. In the illustrated embodiment of the terminal block there are ten such cavities 119, although any other number of cavities may be provided. Each of the cavities 119 is used in the termination of a service wire 120.

Electrical connections with conductors 121 and 122 in service wire 120 are effected by a pair of insulation-penetrating, quick-connect terminals 130 and 131. Each of terminals 130 and 131 includes a generally rectangular central portion 132 which as integral therewith and extending outwardly away therefrom a pair of generally tapered beams 133 and 134. Beams 133 and 134 extend outwardly from central portion 132 in a generally convergent relationship. Extending outwardly away from central portion 132 in a direction opposed to that of beams 133 and 134 is a wire-wrap terminal 135. Integral with wire-wrap terminal 135 is a beam member 136. The beam member 136 is spaced apart from central portion 132 by a distance approximately equal to a thickness of side 115 and extends generally perpendicularly to the wire-wrap terminal 135. Central portion 132, beams 133 and 134, wire-wrap terminal 135 and beam member 136 all lie in a common plane. Additional details of terminals 130 and 131 are presented in my copending application Ser. No. 710,019 filed July 30, 1976.

To ensure proper engagement of terminals 130 and 131 with conductors 122 and 121, respectively, as shown in FIG. 3, with the requisite electrical and mechanical isolation, pairs of terminals 130 and 131 are positioned and aligned by beam member 136 and appropriate shaping of side 115. This alignment is effected, as shown in FIG. 4, by notches 141 and 142 which lie at roots and peaks, respectively, of generally sawtooth shaped projections 143 in side 115. Notches 141 and 142 have a width and a depth approximately equal to a width and a thickness dimension of wire-wrap terminal 135. Furthermore, projections 143 have a thickness dimension approximately equal to the spacing between beam member 136 and central portion 132 of terminals 130 and 131. It should be noted that projections 143 are not correctly illustrated in FIG. 1 because a proper illustration would result in a coincidence of the projection outline with the main perspective lines and this would confuse the illustration of the main structure.

With terminals 130 and 131 aligned as described, tapered beams 133 and 134 extend into one of the cavities 119, as shown in FIG. 1, while wire-wrap terminal 135 is outside. It should be noted, also, that with this alignment, terminals 130 and 131 lie in first and second parallel planes which are parallel with a plane containing base 111 and that terminal 130 is laterally offset from terminal 131. Anchoring terminals 130 and 131 in the aligned position is achieved by sawtooth shaped projections 144 on cover member 140, as shown in FIG. 4. Projections 144 have peak and root portions which engage corresponding root and peak portions of projections 143 on side 115.

Cover member 140 has a plurality of spaced-apart, generally rectangular apertures 145, most clearly shown in FIG. 1. When cover member 140 is properly aligned atop body member 110 by L-shaped projections 146 and 147, shown in FIG. 4, apertures 145 are positioned above cavities 119 in a one-to-one correspondence.

Both body member 110 and cover member 140 are molded of an impact resistant, thermally stable, ultraviolet light insensitive material such as a carbon filled acrylonitrile butadiene styrene. Consequently, cover member 140 can be advantageously secured to body member 110 by ultrasonic welding, for example.

Adjacent to side 115, as shown in FIG. 1, is an extension of base 111. This extension, along with similar extensions on ends 112 and 113 and cover member 140, produces an enclosure 150 for the wire-wrap terminals 135. After individual leads 151 in cable 152 are terminated on wire-wrap terminals 135, the connections can be advantageously sealed against environmental contaminants by injecting into enclosure 150 a potting compound 153 which adheres to acrylonitrile butadiene styrene. Such a potting compound is a filled polyester.

Figure 6:
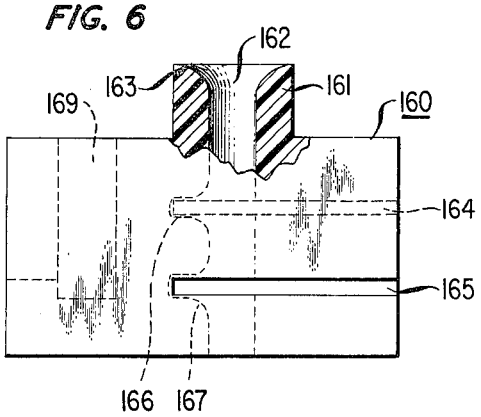
FIG. 6 is a sectional view of the service wire accepting apparatus.
Figure 7:
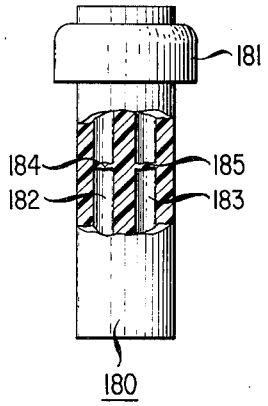
FIG. 7 is a partially cut-away perspective view of a combination buried service wire adapter and wire acceptance port closure.
Figure 5:
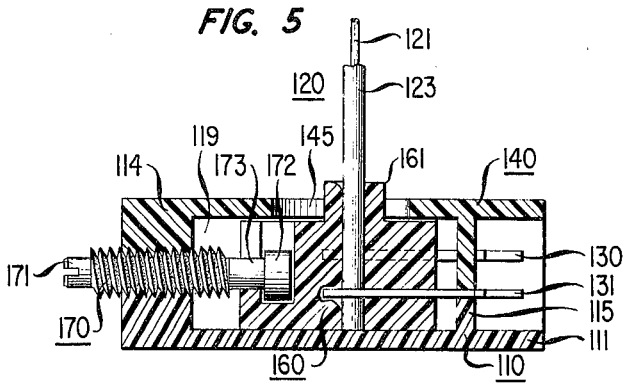
FIG. 5 is a sectional view of the terminal block illustrating a completed connection.

Service wire 120 is held in proper alignment as it is brought into engagement with terminals 130 and 131 by a generally rectangular-shaped member 160 which is slidably engageable with one of the cavities 119. Integral with and extending outwardly from a central portion of member 160 is a cylindrical extension 161 which passes through apertures 145 in cover member 140. A generally oval-shaped aperture 162 extends through the interior of cylindrical extension 161, as shown in FIG. 6, and into the central portion of member 160. The structure just described serves as an acceptance port for service wire 120. Insertion of service wire 120 into aperture 162 is facilitated by flared end 163.

At one end of member 160 is a pair of grooves 164 and 165. Groove 164 is cut or molded into one side face of member 160 while groove 165 is cut or molded into an opposite side face. Moreover, groove 164 is vertically displaced with respect to groove 165 by a distance equal to the vertical separation distance between terminals 130 and 131. The grooves 164 and 165 extend inwardly into member 160 to a point just beyond aperture 162. In order to reduce insulation buildup as terminals 130 and 131 make electrical connection with service wire 120, depressions 166 and 167 having faired entry faces are provided at the terminus of grooves 164 and 165, respectively.

A generally T-shaped slot 168, as shown most clearly in FIG. 3, is formed in member 160 at an end opposite to the end containing grooves 164 and 165. Slot 168 extends inwardly along an end portion of member 160 to an intermediate point. A cross arm 169 of T-shaped slot 168 lies in a plane perpendicular with first and second parallel planes containing grooves 164 and 165.

Urging member 160, carrying service wire 120, into engagement with terminals 130 and 131 is effected by screw 170. At one end of screw 170 is a drive head 171 and at the opposite end is a cylindrical head 172. Juxtaposed head 172 is a section 173 having a diminished shaft diameter. Cylindrical head 172 and dimiished diameter section 173 slidably engage T-shaped slot 168 to couple member 160 to screw 170. Threads 175 to engage screw 170 are molded into the body member 110 and cover member 140.

In operation service wire 120 is inserted into aperture 162 and screw 170 is driven into body member 110. Member 160, being coupled to screw 170, slidably advances toward terminals 130 and 131. Grooves 164 and 165 engage terminals 130 and 131. As member 160 continues its advance, beams 133 and 134 pierce the insulation surrounding service wire 120 and make electrical connection with substantially diametrically opposite sides of conductors 121 and 122.

A generally oval-shaped plug 180 inserted into aperture 162 in member 160 adapts the terminal block to permit the termination of buried service wires. Plug 180 has a cross-sectional area which is approximately equal to the cross-sectional area of aperture 162. Extending lengthwise through an internal portion of plug 180 are a pair of parallel spaced-apart cylindrical apertures 182 and 183. The spacing between apertures 182 and 183 is such that the buried service wires, which are not joined together by common insulation, will have the proper spacing for engagement with terminals 130 and 131.

Integral with and encircling one end of plug 180 is a cap-like protrusion 181 which has an inner shape adapted to tightly engage cylindrical extension 161. Protrusion 181, in conjunction with thin membranes 184 and 185 intersecting apertures 182 and 183 at an intermediate point along their length, provides protection of unused service wire acceptance ports in member 160 against moisture, insects and particular contaminants. Plug 180 and protrusion 181 are comprised of an elastomeric material such as, for example, plasticized polyvinylchloride.

In all cases it is to be understood that the above-described embodiment is illustrative of but a small number of many possible specific embodiments which can represent applications of the principles of the invention. Thus, numerous and various other embodiments can readily be devised in accordance with these principles by those skilled in the art without departing from the spirit and scope of the invention.

What is claimed is:

1. A wire terminal block including at least one pair of insulation penetrating quick-connect terminals, each of said terminals having provision therein for making an electrical connection with opposite sides of an insulation covered electrical conductor, means for accepting a coupled pair of insulation covered electrical conductors, said accepting means including a generally rectangular-shaped member, first and second grooves in opposite sides of said member, said grooves displaced from one another so as to be in alignment with said pair of insulation penetrating quickconnect terminals, means, integral with and extending outwardly from a central portion of said rectangular-shaped member, for receiving said coupled pair of insulation covered electrical conductors, said receiving means having a generally oval-shaped aperture therein which extends through said rectangular-shaped member, an axis of said oval-shaped aperture perpendicularly intersecting first and second parallel planes containing said first and second grooves, and first and second depressions having faired entry faces at a terminus of said first and second grooves, said depressions juxtaposed said oval-shaped aperture to reduce insulation buildup as said quick-connect terminals make electrical connection with said insulation covered electrical conductor, and means for urging said accepting means and said pair of insulation penetrating quick-connect terminals into engagement with one another.

2. The wire terminal block in accordance with claim 1 wherein each of said quick-connect terminals includes a generally rectangular central portion, a pair of generally tapered beams, integral with said central portion, said beams extending outwardly away from said central portion in a generally convergent relationship, a wire-wrap terminal integral with said central portion, said wire-wrap terminal extending outwardly away from said central portion in a direction opposed to that of said pair of beams, and a beam member integral with said wire-wrap terminal, said beam member being spaced apart from said central portion, extending generally perpendicularly to said wire-wrap terminal and lying in a plane containing said wire-wrap terminal and said central portion.

3. The wire terminal block in accordance with claim 1 further including a body member having a plurality of generally rectangular cavities extending laterally across a width dimension, means, integral with end portions of said body member, for mounting said terminal block to a support structure, a cover member having a plurality of spaced-apart generally rectangular apertures therein, means for aligning said cover member and said body member so that said plurality of apertures in said cover member are positioned atop said plurality of cavities in said body member in one-to-one correspondence, and means for securing said cover member to said body member.

4. The wire terminal block in accordance with claim 3 wherein said body member and said cover member are comprised of an impact resistant, thermally stable, ultraviolet light insensitive material.

5. The wire terminal block in accordance with claim 3 wherein said body member and said cover member are comprised of a carbon filled acrylonitrile butadiene styrene.

6. The wire terminal block in accordance with claim 3 wherein each of said quick-connect terminals includes a generally rectangular central portion, a pair of generally tapered beams, integral with said central portion, said beams extending outwardly away from said central portion in a generally convergent relationship, a wire-wrap terminal integral with said central portion, said wire-wrap terminal extending outwardly away from said central portion in a direction opposed to that of said pair of beams, and a beam member integral with said wire-wrap terminal, said beam member being spaced apart from said central portion, extending generally perpendicularly to said wire-wrap terminal and lying in a plane containing said wire-wrap terminal and said central portion.

7. The wire terminal block in accordance with claim 6 further including means, integral with said body member, for aligning pairs of said quick-connect terminals within individual ones of said rectangular cavities, said terminals being aligned in first and second parallel planes which are parallel with a plane containing a base portion of said body member, said pairs of terminals further being aligned within said cavities laterally offset from one another, and means, integral with said cover member, for anchoring said pairs of aligned terminals between said body member and said cover member.

8. The wire terminal block in accordance with claim 7 wherein said aligning means includes a plurality of generally saw-tooth shaped projections extending along a length dimension of said body member, each of said projections having a first notch at a root and a second notch at a peak, said first and second notches having a width and a depth approximately equal to a width and a thickness dimension of said wire-wrap terminal, said projections further having a thickness dimension approximately equal to a spacing between said beam member and said central portion of said quick-connect terminals.

9. The wire terminal block in accordance with claim 8 wherein said anchoring means includes a plurality of generally saw-tooth shaped projections extending along a length dimension of said cover member, each of said projections on said cover member having a peak and a root portion which engage a corresponding root and peak portion on each of said projections on said body member.

10. The wire terminal block in accordance with claim 6 further including means, integral with said body member, for producing a partial enclosure for said wire-wrap terminals, means, integral with said cover member, for completing the enclosure for said wire-wrap terminals, means for effecting separate electrical connections with each of said wire-wrap terminals, and means, held in said enclosure for said wire-wap terminals, for sealing said separate electrical connections against environmental contaminants.

11. The wire terminal block in accordance with claim 10 wherein said sealing means comprises a plotting compound which adheres to acrylonitrile butadiene styrene.

12. The terminal block in accordance with claim 11 wherein said potting compound comprises a filled polyester.

13. The wire terminal block in accordance with claim 3 wherein said urging means includes a threaded screw member having a drive head at one end and a cylindrical head at an opposite end, said screw member having a section with a diminished shaft diameter juxtaposed said cylindrical head, means, integral with said accepting means, for slidably engaging said diminished diameter section to entrap said cylindrical head, and means, integral with said body member and said cover member, for threadably engaging said screw member.

14.The wire terminal block in accordance with claim 13 wherein said accepting means is slidably engageable with one of said cavities in said body member.

15. The wire terminal block in accordance with claim 14 wherein said means, integral with said accepting means, for slidably engaging said diminished diameter section of said screw member includes a generally T-shaped slot in an end portion of said rectangular-shaped member, said slot extending inwardly along said end portion to an intermediate point, a cross arm of said T-shaped slot lying in a plane perpendicular with first and second parallel planes containing said first and second grooves.

16. The wire terminal block in accordance with claim 14 including means, insertable in an unused oval-shaped aperture, for adapting said aperture for acceptance of an uncoupled pair of insulation covered electrical conductors, said adapting means further including means for sealing an unused oval-shaped aperture against moisture, insects and particulate contaminants.

17. The wire terminal block in accordance with claim 16 wherein said adapting means includes a generally oval-shaped plug member having a cross-sectional area approximately equal to a cross-sectional area of said oval-shaped aperture, and first and second parallel, spaced-apart cylindrical apertures extending lengthwise through an internal portion of said plug member.

18. The wire terminal block in accordance with claim 17 wherein said sealing means includes a cap-like protrusion extending circumferentially around an end of said plug, said protrusion having an inner shape adapted to tightly engage a corresponding shape of said electrical conductor receiving means, and a membrane perpendicularly intersecting said first and second cylindrical apertures at an intermediate point along their length.

19. The wire terminal block in accordance with claim 18 wherein said plug member and said cap-like protrusion are comprised of elastomeric material.

* * * * *

UNITED STATES PATENT AND TRADEMARK OFFICE

CERTIFICATE OF CORRECTION

PATENT NO. : 4,040,701

DATED : August 9, 1977

INVENTOR(S) : Tillman J. Gressitt

It is certified that error appears in the above-identified patent and that said Letters Patent are hereby corrected as shown below:

Col. 7, line 49, claim 11, "plotting" should read --potting--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*